US007147350B1

(12) United States Patent
Schofield

(10) Patent No.: US 7,147,350 B1
(45) Date of Patent: Dec. 12, 2006

(54) PORTABLE LIGHT MODIFICATION DEVICE

(76) Inventor: David P. Schofield, 106 Cooper's Pond Dr., Lawrenceville, GA (US) 30044

( * ) Notice: Subject to any disclaimer, the term of this patent is extended or adjusted under 35 U.S.C. 154(b) by 30 days.

(21) Appl. No.: 11/040,008

(22) Filed: Jan. 24, 2005

Related U.S. Application Data

(60) Provisional application No. 60/537,915, filed on Jan. 22, 2004.

(51) Int. Cl.
*F21V 9/00* (2006.01)

(52) U.S. Cl. ..... 362/324; 362/322; 362/323; 362/293; 362/282; 362/284

(58) Field of Classification Search ..... 362/319, 362/322, 323, 324, 311, 293, 277, 282, 283, 362/284; 136/291, 293
See application file for complete search history.

(56) References Cited

U.S. PATENT DOCUMENTS 5,060,126 A * 10/1991 Tyler et al. ..... 362/277
6,050,714 A * 4/2000 Isabella ..... 362/568
6,261,228 B1 * 7/2001 Honda et al. ..... 600/180
6,267,478 B1 * 7/2001 Chen ..... 353/84
7,056,006 B1 * 6/2006 Smith ..... 362/644
2003/0137844 A1 * 7/2003 Bucher et al. ..... 362/293

* cited by examiner

*Primary Examiner*—Laura K. Tso
(74) *Attorney, Agent, or Firm*—Fulbright & Jaworski LLP

(57) ABSTRACT

A novel light modification device is described that includes an optical wheel having at least two light modification sections, the optical wheel being turned by an electric powered actuator and the electric power used to operate the actuator being provided by a light power to electric power converter. All of the optical wheel, actuator and light power to electric power converter being mounted on a housing. The housing being supported by a mounting mechanism so that light from a light source is aligned to illuminate the optical wheel and the light power to electric power converter.

10 Claims, 4 Drawing Sheets

PORTABLE LIGHT MODIFICATION DEVICE

CROSS REFERENCE TO RELATED APPLICATION

This application claims priority from U.S. provisional application Ser. No. 60/537,915 filed on Jan. 22, 2004 and this provisional application in its entirety is incorporated in this non-provisional application by reference.

BACKGROUND OF THE INVENTION

1. Field of the Invention

This invention relates generally to a portable device that provides modification of incident light and more specifically to a portable device for projecting light that has been modified by at least two selected modifiers onto a target area with each modified light illuminating the target area for a fixed time.

2. Description of the Related Art

Light illumination of target display areas using light sources such as projection devices, flood or spot lamps are known. Such lighted displays are used both indoors and outdoors for showing-off advertising signs and other displays, or exhibiting seasonal displays and attractions such as during national holidays, e.g., July $4^{th}$ celebrations, or during sporting events, or at Christmas time. Many of these lighted displays are built to be exhibited for long periods of time on semi-permanent or essentially permanent bases. In particular, the lighted displays installed for long periods of operation involve building light sources that are rugged and durable. These light sources, therefore, require that maintenance be minimized and reliability of course, be maximized. To achieve these dual purposes it has been necessary to eliminate features that could have short lifetimes or short times between required repairs. These requirements have necessitated simplifying light fixture designs.

Accordingly, many lighted displays are illuminated with white light or light of a different fixed color. Time variable color lighted target areas have required installation of multiple light projectors for each different color with associated switching devices or alternatively color selector devices that have to be mounted in front of light sources and also have to be powered by electric motors that required separate power lines to be installed. All of these added systems increase costs for installation and maintenance requirements.

SUMMARY OF THE INVENTION

In one aspect, the present invention comprises a time variable light modification device, e.g., a device that over time changes the color or other characteristic of light that illuminates a target area. The light illuminating the target area can be emitted from a fluorescent lamp, halogen lamp, incandescent lamp, spotlight lamp or any other source of light that can be directed to illuminate a target area. The device of the invention can comprise a wheel structure having a plurality of sections or plates mounted on the wheel, with each section having different optical properties, so that this optical wheel can be rotated to modify reflected or transmitted light. This device further includes a converter of light power input to electric power output such as a solar panel, or photoelectric or solar cell. Output electric power is directed in accordance with an aspect of the invention to energize an electrically operable actuator. This actuator may be an electric motor such as a direct current (dc) motor. The mechanical rotation output of the motor can be interconnected to power a gear train that can be configured to rotate the optical wheel at a desired speed or at variable speeds so that optical sections mounted on the wheel are illuminated by a light source. The device of this invention further may include a clamping mechanism that can be used to mount the optical wheel, light power to electric power converter, and motor to a support separate from or included with a light source. The device of this invention can be arranged in or about a housing to have necessary mechanical and electrical connections made between components and to provide a platform for mounting interconnected components to a support using a clamping mechanism. According to a feature of the invention, the time variable light modification device according to the invention may comprise an optical wheel that is a color wheel having a plurality of colored transparent sections for projecting transmitted corresponding colors of light onto a target display area.

According to another feature of the invention, the time variable light modification device may include a plurality of image forming and/or other optical modification sections such as lenses, prisms, etc.

According to another feature of the invention, the time variable light modification device may include one or more variable geometry media such as, e.g., a flexible membrane for forming a prism or lens.

According to a further feature of this invention, the mechanically variable light modification device may include a plurality of arms each connected to a light transmitting panel positionable in a path of incident light, each arm positioning the respective light transmitting panel, such as a color filter or prism, in the path of the light.

According to another aspect of the invention, the energy converter may comprise a solar panel including one or more photoelectric or "solar" cells for converting light power from a light source to electrical power. The solar panel on the device is positioned such that it is illuminated by light emitted from a preselected light source. A regulator may be included to control voltage and/or current output from the electric power converter that is supplied to an actuator so as to maintain a desired rotation speed of an optical color wheel, and otherwise operate the device over a range of light projection conditions. A control circuit further may be incorporated to provide manual and/or automatic control of rotation speed. For example, the control circuitry may be used to move an optical wheel intermittently so as to provide a desired effect, e.g. color of light, for a desired period prior to advancing to another color.

According to another aspect of the invention, a secondary source of power may be included to power an actuator when there is insufficient light available to operate the device.

According to another aspect of the invention, a clamping mechanism may be included and the clamping mechanism may include a spring or similar mechanism for biasing a set of jaws close about a support. The clamping mechanism and/or device housing may be made of a thermally tolerant material, such as a high temperature plastic, compatible with temperatures generated by a light, e.g., an incandescent light source such as a floor lamp or spotlight.

According to another aspect of the invention, a light projection system including a time variable light modification device according to the present invention can be mechanically coupled to an electrically operable actuator for controlling transmission of light. A power converter receives a portion of the light projection system light to supply electric power to an actuator. A clamping mechanism may be used to mount the aforementioned components to a support and/or a source of light for the light projection system. A housing may contain one or more of the components in operable mechanical and electrical relation with others of the components and provide a platform for mounting the components to the support or light source via a clamping mechanism.

SUMMARY DESCRIPTION OF THE DRAWINGS

DETAILED DESCRIPTION OF THE INVENTION

The present invention is described at least in part in copending provisional patent application Ser. No. 60/537,915 filed on Jan. 22, 2004 from which priority is claimed and which is incorporated in this non-provisional application by reference.

Figure 1B:
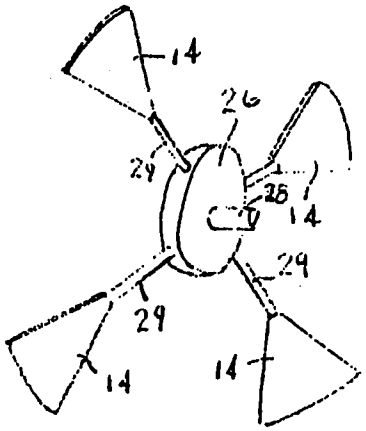
FIG. 1B shows a perspective side view of an alternative optical wheel according to the present invention; and, FIGS. 2, 3 and 4 show alternative block diagrams for light modification device component configurations.
Figure 1A:
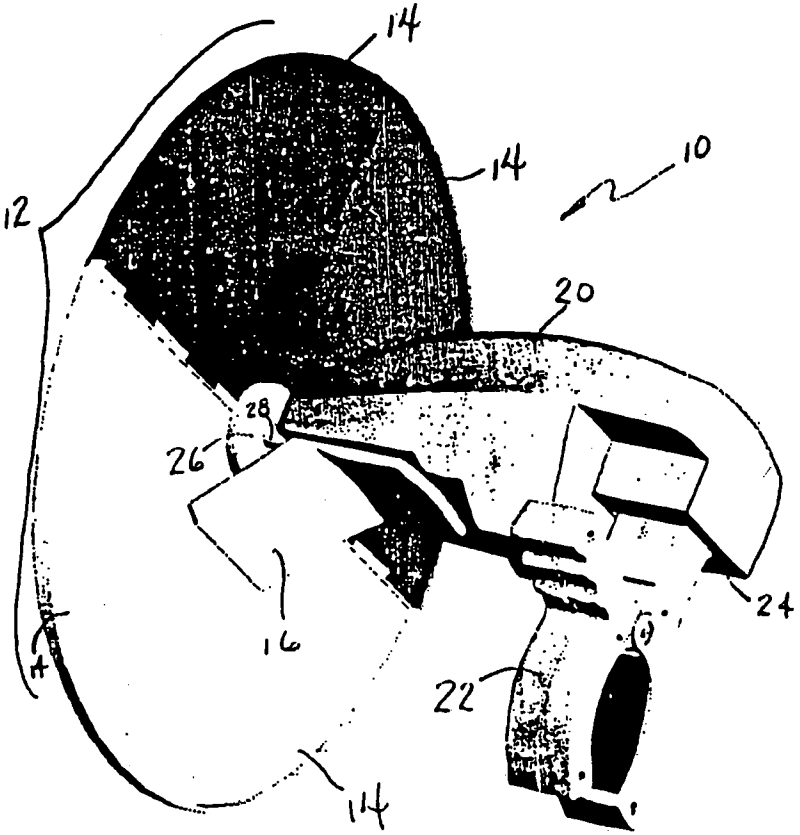
FIG. 1A shows a perspective side view of a time variable light modification device according to the present invention.

A time variable light modification device, according to the present invention, is shown in FIG. 1A in perspective view and is designated with the general reference numeral 10. This light modification device 10 includes at least one optical wheel 12 that includes at least two light modification sections 14. Each light modification section 14 has a different or alternate optical characteristic so that light transmitted through the light modification sections 14 or reflected from the light modification sections 14 is modified, e.g., the light modification sections 14 can be color tinted clear or color tinted translucent panels, or they can have diffraction patterns or be lenses or prisms, etc. The optical wheel 12 can include a high plurality of light modification sections 14. An assembled optical wheel 12 can include a collection of alternating colored light modification sections 14. Alternatively, an assembled optical wheel 12 can include any mixture of colored or optically refracting, reflecting or diffracting light modification sections 14 including light modification sections 14 having images affixed to them, embedded in them or cut out of them.

The light modification device 10 shown in FIG. 1A also includes a solar panel 16 capable of converting light power to electric power. Electric power output from the solar panel 16 is directed to power an electric motor 18 (not shown in FIG. 1A, see FIGS. 2–4) that in turn rotates the optical wheel 12.

The optical wheel 12 shown in FIG. 1A is mounted from a housing 20 with an electric motor 18 and other associated components utilized to rotate the optical wheel 12 mounted in the housing 20. In application, the light modification device 10 can be mounted in close proximity to a light source, such as a high intensity incandescent or halogen lamp. Such an arrangement can subject the light modification device 10 to very high temperatures. Accordingly, the housing 20 can be made of heat tolerant materials, such as heat resistant plastic. By making the housing 20 and the contained components of heat tolerant materials, the light modification device 10 can be mounted in close proximity or even contact with a high temperature light source without causing damage to the light modification device 10 or the light source. Preferably, the housing 20 should be made of a durable and lightweight material suitable for use indoors and outdoors.

A mounting mechanism 22 is shown extending from the light modification device 10 shown in FIG. 1A. This mounting mechanism 22 can be a locking grip, strap, belt or other structure for attaching the light modification device 10 to a support, or fixture containing a light source. The mounting mechanism 22 may be in a fixed relationship to the housing 20 of the light modification device 10, or the mounting mechanism 22 can be attached to the housing 20 by an articulating joint 24 so that the orientation of the mounting mechanism 22 with respect to the housing 20 can be adjusted to optimize a mounting of the light modification device 10 with respect to a light source.

In operation, the light modification device 10 is mounted in relation to a light source so that the solar panel 16 and at least a portion of the optical wheel 12 are within a path of light emitted by the light source. Thus at least a portion of the optical wheel 12 is illuminated by light from the light source so that transmitted, reflected or diffracted light is modified in color, etc. and directed to a target area where a display, advertising or other subject matter to be lighted is illuminated.

As an alternative aspect of the invention, the optical wheel 12, instead of being assembled from adjacent abutting mounted light modification sections 14 that are interconnected by an attachment plate 26 to a drive shaft 28, the optical wheel 12 can be assembled from adjacent mounted light modification sections 12 using arms 29 attached at one end to an attachment plate 26 and at the other to light modification sections 14 (see FIG. 1B). The optical wheel 12, whether made as shown in FIG. 1A or 1B, can be circular in its outside shape or, as one of skill in the art would appreciate, it can have other outside shapes, such as triangular, rectangular or oval.

The light modification device 10 may be mounted relative to a light source so that it is in a "high profile" arrangement with about 25 percent of the optical wheel 12 illuminated by a light source at any time. Alternatively, the light modification device 10 can be mounted with an optical wheel 12 arranged in accordance with the embodiment shown in FIG. 1B, and in this configuration a target area is illuminated on an intermittent or "low profile" basis with light modified by light modification device 10.

Figure 2:
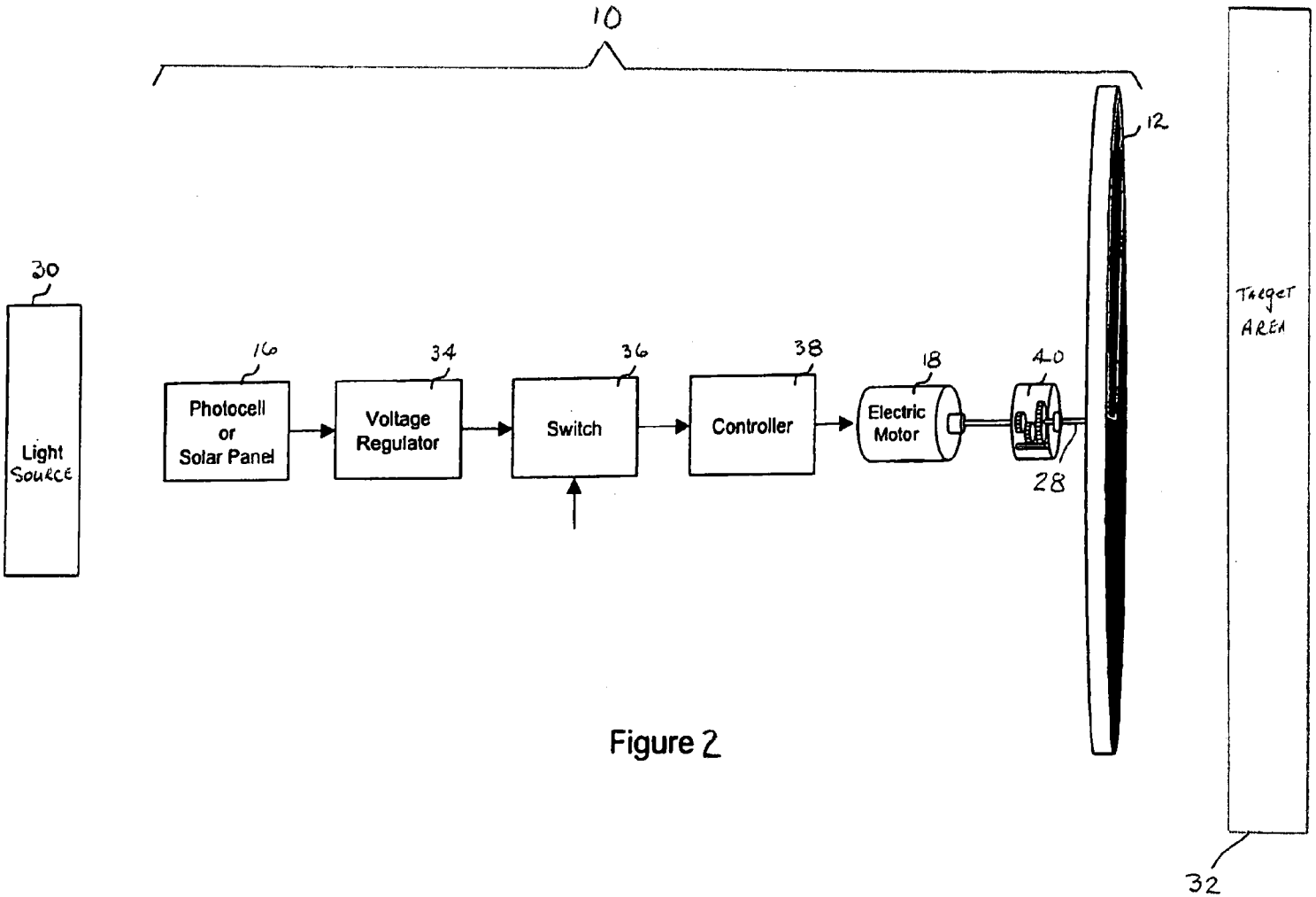

Shown in FIG. 2 is a block diagram with a light source 30, target area 32 and a light modification device 10. Components shown in FIG. 2 for a light modification device 10 include a solar panel 16, voltage regulator 34, switch 36, controller 38, motor 18, gearbox 40, drive shaft 28 and optical wheel 12. The inclusion and arrangement of components for a light modification device 10 shown in FIG. 2 permits light from light source 30 to illuminate both optical wheel 12 and solar panel 16. Light incident on solar panel 16 is converted to electric power that is processed by a voltage regulator 34, as in known in the art, to provide electric power at selected values usable by other light modification device 10 components. Provision of this regulated electric power is switched to other components using switch 36, which can be a manual, programmed or remotely operated switch. Output from switch 36 is provided to controller 38 that further processes input electric power to energize and operate electric motor 18. As such, electric motor 18 is operated to output fixed or variable mechanical rotation power. This output mechanical power is input to gearbox 40 to turn drive shaft 28 and in turn rotate optical wheel 12. In this combination, light from light source 30 both is modified at timed intervals by optical wheel 12 light modification sections 14 and also is used to power the components of light modification device 10 so that target area 32 is appropriately illuminated.

Figure 3:
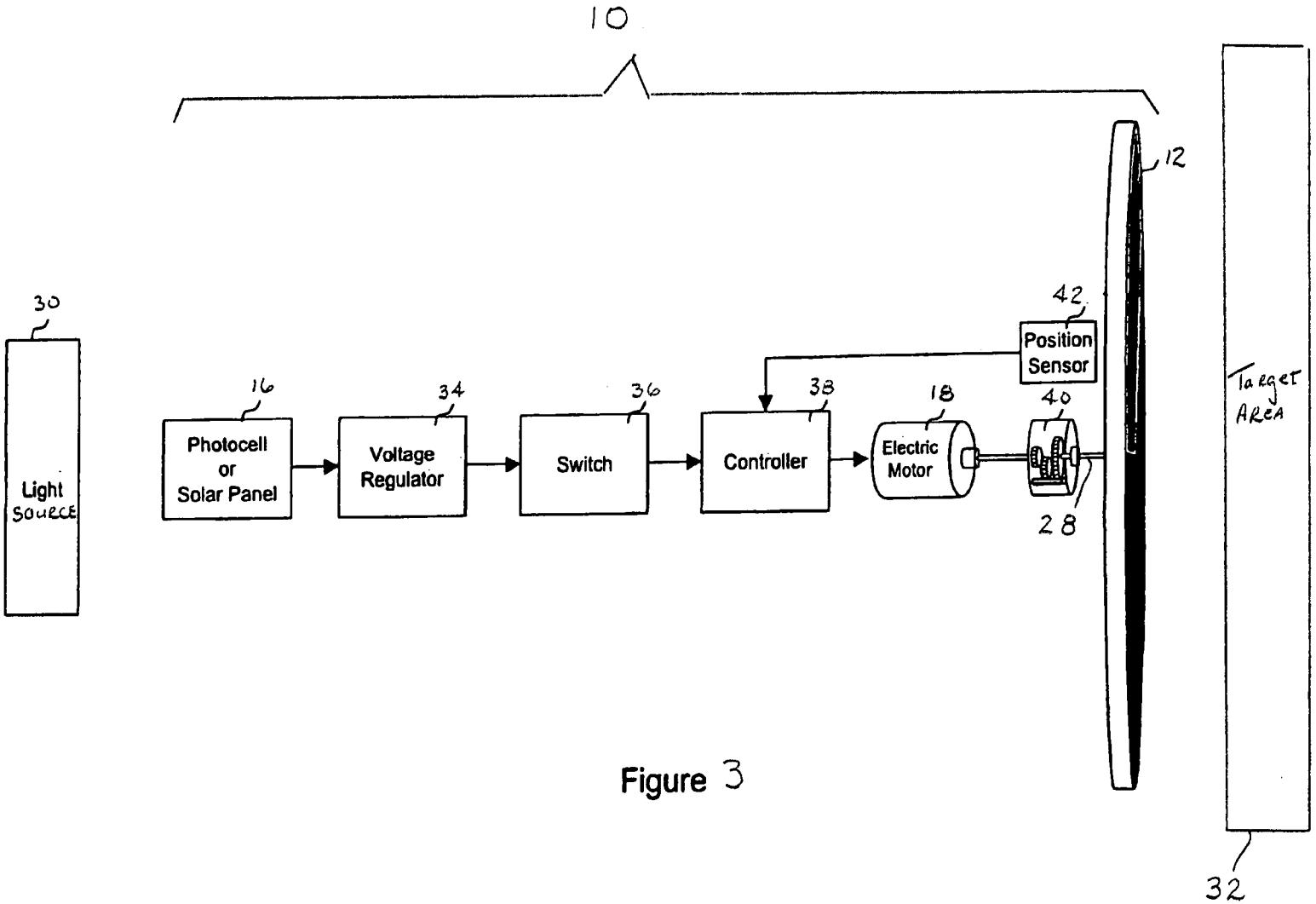

Shown in FIG. 3 is a block diagram for another aspect of the invention. Here in addition to all components shown in FIG. 2, the light modification device 10 includes a position sensor 42 arranged to monitor rotation of optical wheel 12 and output information on such rotation to controller 38 that provides electric power to motor 18 which in response outputs fixed or variable mechanical rotation power to turn optical wheel 12. In this combination, light from light source 30 also both is modified at timed intervals by optical wheel 12 modification sections 14 and is used to power the components of light modification device 10 so that target area 32 is appropriately illuminated.

Figure 4:
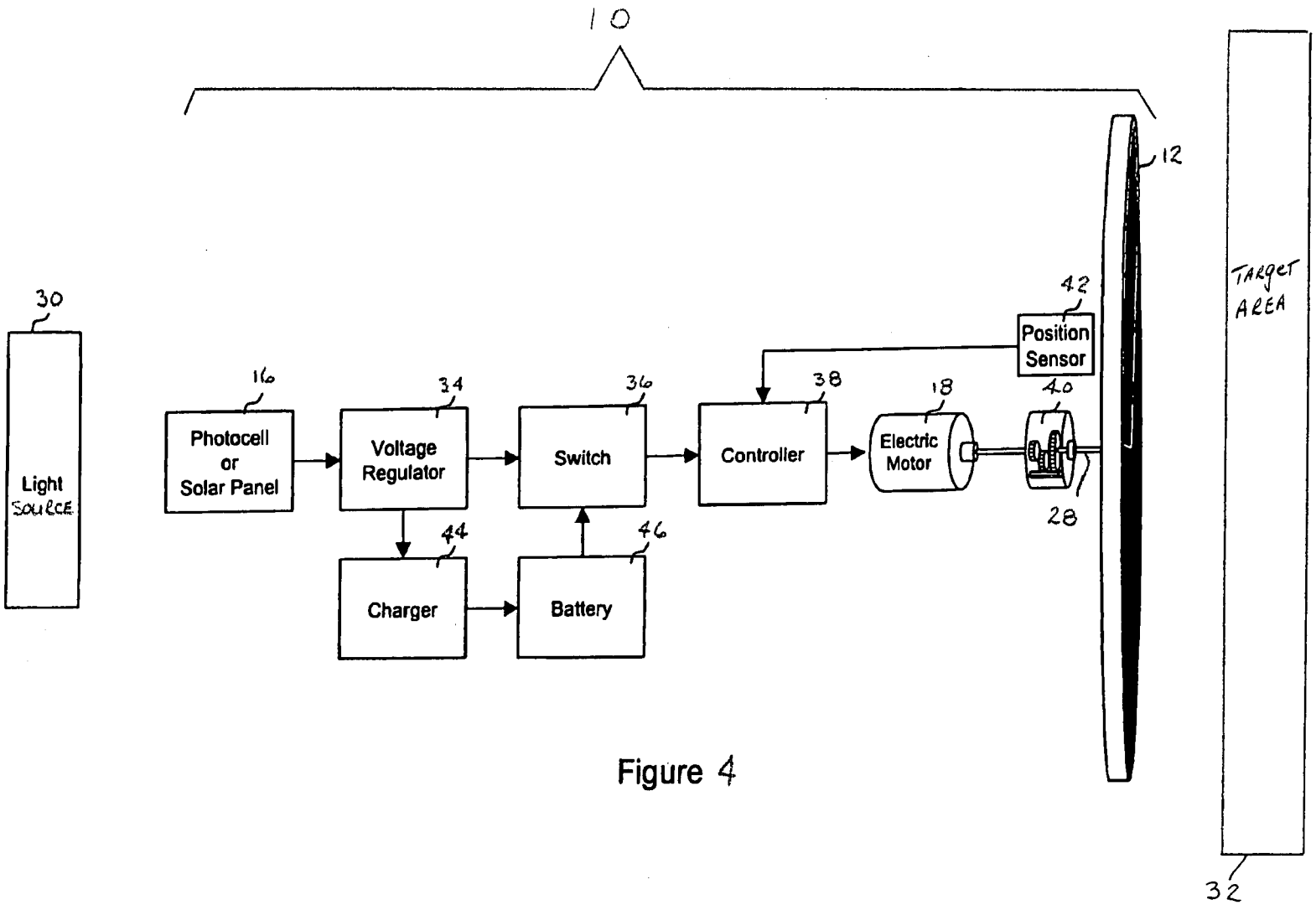

Shown in FIG. 4 is a block diagram for another aspect of the invention. Here in addition to all components shown in FIG. 3, the light modification device 10 includes a charger 44 and a battery 46. In this arrangement electric power from voltage regulator 34 is input to charger 44 that in turn charges battery 46. Power output from battery 46 is provided to switch 36 so that controller 38 and motor 18 can be energized. As such, when insufficient power is provided from solar panel 16 to operate motor 18 there is a back up source of power that can be provided from battery 46.

The description of illustrative aspects and best modes of the present invention is not intended to limit the scope of the invention. Various modifications, alternative constructions and equivalents may be employed without departing from the true spirit and scope of the appended claims.

What is claimed is:

1. A light modification device comprising:

an optical wheel including at least two light modification sections;

an electric powered actuator having a rotatable drive shaft, said optical wheel disposed from said drive shaft;

a light power to electric power converter disposed to provide electric power to said actuator;

a housing on which said actuator and said light power to electric power converter are disposed; and, a mounting mechanism disposed from said housing to support said housing for alignment with light from a light source.

2. The light modification device according to claim 1 further comprising an articulating joint disposed from said housing, said mounting mechanism disposed from said articulating joint.

3. The light modification device according to claim 1 wherein said light power to electric power converter is a solar cell.

4. The light modification device according to claim 1 further comprising a controller disposed to receive electric power from said light power to electric power converter and further disposed to output electric power to said actuator.

5. The light modification device according to claim 4 further comprising a position sensor disposed to monitor positions of said color wheel and further disposed to output signals derived from the positions to said controller.

6. The light modification device according to claim 1 further comprising a voltage regulator disposed to receive electric power from said light power to electric power converter and further disposed to output power for said actuator.

7. The light modification device according to claim 6 further comprising a charger disposed to receive electric power from said regulator, and a battery disposed to receive power from said charger, and said battery further disposed to output power for said actuator.

8. The light modification device according to claim 1, wherein said optical wheel includes having said light modification sections in contact with each other.

9. The light modification device according to claim 1, wherein said optical wheel includes an attachment plate, at least two arms disposed from said attachment plate and at least one light modification section disposed from each arm.

10. The light modification device according to claim 1, wherein said mounting mechanism is a clamping jaws.

* * * * *